US006662378B2

(12) United States Patent
Vartanyan

(10) Patent No.: US 6,662,378 B2
(45) Date of Patent: Dec. 16, 2003

(54) COMBINED WAIST-WORN MEN'S CLOTHES ARTICLE

(75) Inventor: Philip A. Vartanyan, Moscow (RU)

(73) Assignee: Charles Avsharian, Ann Arbor, MI (US)

( * ) Notice: Subject to any disclaimer, the term of this patent is extended or adjusted under 35 U.S.C. 154(b) by 0 days.

(21) Appl. No.: 10/029,091

(22) Filed: Dec. 21, 2001

(65) Prior Publication Data

US 2002/0053102 A1 May 9, 2002

Related U.S. Application Data

(63) Continuation-in-part of application No. PCT/US00/10087, filed on Apr. 14, 2000.

(30) Foreign Application Priority Data

Jun. 6, 1999 (RU) ..... 99112917

(51) Int. Cl.[7] ..... A41B 9/02
(52) U.S. Cl. ..... 2/403; 2/400
(58) Field of Search ..... 2/403, 400, 401, 2/402, 404, 405, 67, 446, 78.1, 78.2, 78.3, 109, 406, 408, 407, 234, 228, 227, 238, 69; 602/68, 70, 73, 67, 69, 71

(56) References Cited

U.S. PATENT DOCUMENTS 1,781,271 A * 11/1930 Cowdrey
2,983,924 A * 5/1961 Cohen et al. ..... 2/67
4,195,630 A * 4/1980 Connery, deceased et al. ..... 128/159
4,345,337 A * 8/1982 Chung ..... 2/405
4,526,167 A * 7/1985 Ebenal, deceased et al. .. 602/70
4,637,078 A * 1/1987 Southwell ..... 2/408
4,961,419 A * 10/1990 Tribble et al. ..... 602/70
5,283,912 A * 2/1994 Chung ..... 2/403
5,598,587 A * 2/1997 Wada ..... 2/403
5,647,065 A * 7/1997 Richerson ..... 2/403
5,716,350 A * 2/1998 Ryan ..... 604/385.1
5,870,779 A * 2/1999 Heron ..... 2/403
5,875,495 A * 3/1999 Thrower ..... 2/403
5,978,971 A * 11/1999 Wald ..... 2/403
6,038,703 A * 3/2000 Chung ..... 2/403
6,061,840 A * 5/2000 Alligator ..... 2/403
6,108,823 A * 8/2000 Danes ..... 2/403
6,243,880 B1 * 6/2001 Lyden ..... 2/228
6,287,169 B1 * 9/2001 Willms et al. ..... 450/101
6,289,520 B1 * 9/2001 Page ..... 2/403
6,308,342 B1 * 10/2001 Qi ..... 2/403
6,425,140 B1 * 7/2002 Vitches ..... 2/403

* cited by examiner

*Primary Examiner*—John J. Calvert
*Assistant Examiner*—Alissa L Hoey
(74) *Attorney, Agent, or Firm*—Rader, Fishman & Grauer PLLC

(57) ABSTRACT

The invention relates to light industry and particularly to men's clothes.

A combined waist-worn men's clothes article comprises an outside portion and an inside portion connected to each other, the inside portion being shaped as swimming trunks. The swimming trunks comprise a front panel and a back panel connected to each other by side seams and having an additional panel connected to the front panel by side seams and a middle seam. The additional panel forms a cavity with the front panel, the latter being provided with a slot for communication between the inside portion and the cavity. The back panel and the front panel are connected to each other by an additional seam aligned with the middle seam located at the level of the bottom edge of the scrotum.

8 Claims, 7 Drawing Sheets

COMBINED WAIST-WORN MEN'S CLOTHES ARTICLE

CROSS-REFERENCE TO RELATED APPLICATIONS

The present application is a continuation-in-part application claiming priority in part to the International Application PCT/US00/10087 (Publication WO00/78166) filed Apr. 14, 2000 under 35 U.S.C. §§120 and 365(c).

BACKGROUND OF THE INVENTION

1. Field of the Invention

The invention relates to light industry and particularly to men's clothes.

2. Description of the Related Art

Known in the art is a combined waist-worn men's clothes article comprising an outside shorts-like portion and an inside swimming-trunks-like portion connected to each other (French Application No. 2564706, C1. A 41D 1/06, Nov. 29, 1985). This structure, though convenient in using, does not allow isolating men's genitalia from perineum and front thigh surfaces. Irritation and inflammation of those parts results from that, especially upon getting urine drops or other natural secretions thereon. All in all, this results in the feeling of discomfort for a person.

Also known in the art is a combined waist-worn men's clothes article comprising an outside and an inside portions connected with each other. The inside portion is made as swimming trunks comprising of a front panel, back panel, and additional panel. The front panel and back panel are connected to each other by side seams and have outside edges shaping holes for legs. The additional panel is connected with the front panel in the side seams and a middle seam located in the area of perineum. The additional panel and front panel form a cavity therebetween. The front panel has an oval opening for communicating the inside portion with the cavity (PCT Application No. 18021, C1. A41B 9/02, Oct. 29, 1992). In this item, the opening only lets the penis out, the end thereof being fixed by a special ring attached to the front panel. The scrotum, with no support therefor, is left cooperating with the perineum, which results in all of the above-mentioned disadvantages.

The latter invention is assumed to be the closest analog for the present invention.

SUMMARY OF THE INVENTION

The object of the present invention is to provide hygienic and convenient structure allowing for the feeling of comfort in any positions of the body and in any circumstances of the use of the structure: in sport, recreation, military activity, or emergency situations.

The object is met by means of providing a combined waist-worn men's clothes article that comprises an outside portion and an inside portion connected to each other, the inside portion being shaped as swimming trunks comprising a front panel and a back panel connected to each other by side seams and having outside edges for forming holes for legs, and an additional panel connected to the front panel by side seams and a middle seam in the area of perineum and forming a cavity therewith, the front panel being provided with a slot for communication between the inside portion and the cavity, the back panel and the front panel being connected to each other by a seam aligned with the middle seam located at the level of the bottom edge of the scrotum, a longitudinal axis of the slot being at a distance from the middle seam no less than a half-height of a testicle, the additional panel being connected to the front panel along the outside edges thereof, and the back panel and the additional panel being connected to the outside portion in the waist area through an intermediate element.

Beside that, the object is met due to providing means for detachable connecting the front panel, the back panel, and the intermediate element with each other, and also due to providing the additional panel consisting of an upper and a lower elements, the lower element being of a three-dimensional shape, the outside portion being either boxer trunks, or shorts, or drawers, or pants, or wide trousers, or leggings, or breeches, or spandex, or buckskin breeches, or riding breeches.

In another aspect of the present invention, men's briefs comprise a front panel and a back panel connected to each other to form a first cavity therebetween. The front panel is provided with a first gusset in a central part of the panel, and the first gusset is made with a fly front portion. There is a second gusset affixed to the first gusset to form a second cavity therebetween. The second gusset preferably made netlike is provided with an opening to establish communication between the first and the second cavities. The opening is preferably round and its diameter is selected to be large enough to pass genitalia of a user through. The opening may be provided with an elastic cuff. The fly front portion of the front panel may have a zipper closure.

BRIEF DESCRIPTION OF THE DRAWINGS

The essence of the invention is illustrated in drawings, wherein.

DESCRIPTION OF THE PREFERRED EMBODIMENTS

Figure 1:
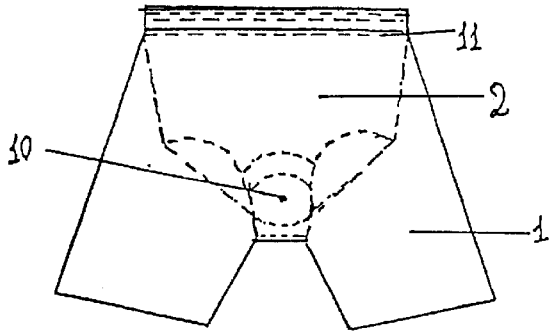
FIG. 1 is a general view of a combined waist-worn men's clothes article.
Figure 3:
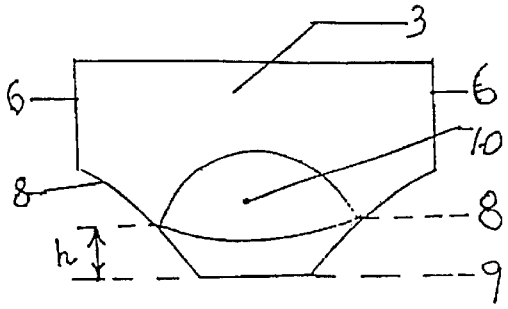
FIG. 3 shows a front panel.
Figure 2:
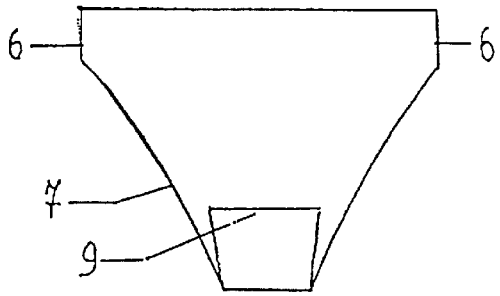
FIG. 2 shows a back panel.

Referring to FIGS. 1–4, connected to each other in a combined waist-worn men's clothes article are an outside portion 1 and an inside portion 2, the inside portion being made as swimming trunks. The swimming trunks comprise a front panel 3, a back panel 4, and an additional panel 5. The back panel 4 is connected to the front panel 3 by side seams 6. The back panel 4 has outside edges 7, the front panel has outer edges 8. The edges 7 and 8 serve to form holes for legs. The additional panel 5 is connected to the front panel 3 by the side seams 6, a middle seam 9 located in the area of perineum, and by the outer edges 8.

As a result of such a connection, a cavity is formed to accommodate genitalia. The front panel 3 has a slot 10 to allow communication between the inside portion 2 and the cavity and for the genitalia, the penis and scrotum, to pass through into the cavity. The back panel 4 and the front panel 3 are connected to each other by a seam aligned with the middle seam.

In such a way, a seam connecting the front, back, and additional panels is a single seam, and cuts entering the seam are assigned the same reference numeral 9 in the drawings. The seam 9 is located at a level of the bottom edge of the scrotum, whereas a longitudinal axis of the slot 10 is located at the distance "h" from the middle seam equal to no less than half of the maximum height of a testicle. Such a realization saves the perineum the trouble of seams and prevents same from abrasion, conveniently positions the scrotum providing a support therefor, the penis and scrotum being completely separated from the perineum and prevented from returning back to the inside portion at all movements of a user's body, whereby total comfort for the user is provided. The back and additional panels are connected to the outside portion 1 through an intermediate element 11.

Various means such as buttons, press-buttons, Velcro strips can be provided to detachably connect those panels and the intermediate element 11. The detachable connection allows for fast taking the inside portion out, and, when needed, washing or replacing it without touching upon the outside portion.

Through its height, the additional panel 5 comprises two elements 12 and 13. The bottom element 13 is imparted a three-dimensional shape similar to, for example, a "cup" of a bra. Such a structural realization is used upon designing articles of haute couture for emphasizing the beauty of the body and sex appeal.

The outside portion 1 can be either boxer trunks, or shorts, or drawers, or pants, or wide trousers, or leggings, or breeches, or spandex, or buckskin breeches, or riding breeches.

Provided with a soft elastic band are an upper edge of the front panel 3, the edges 7 and 8, and the perimeter of the slot 10.

To use the clothes article, it will suffice to lower the front panel 3, without unzipping pants, shorts, or any other outside portion.

Figure 4:
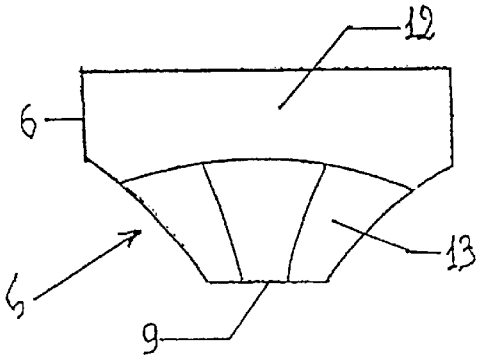
FIG. 4 shows an additional panel.
Figure 5:
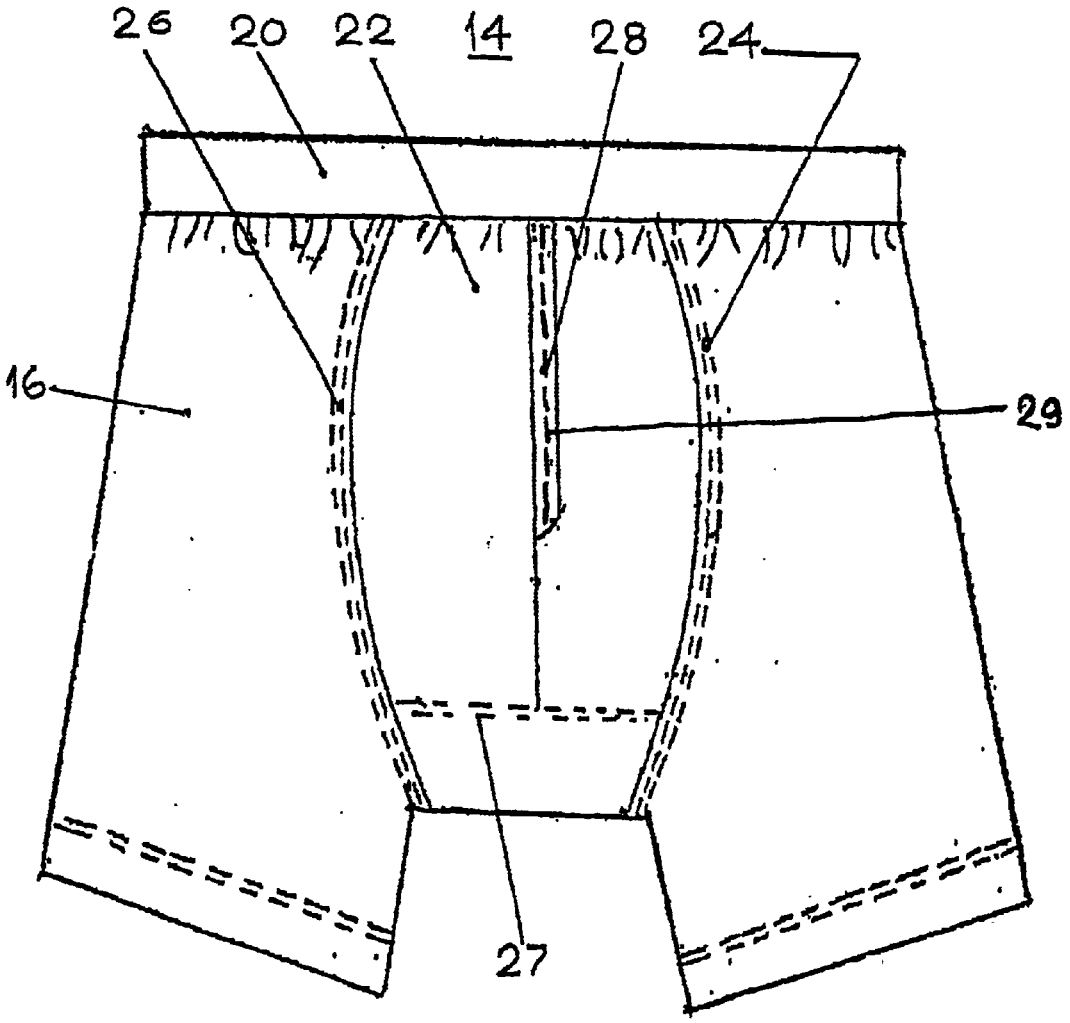
FIG. 5 shows a front panel in accordance with another aspect of the invention.
Figure 6:
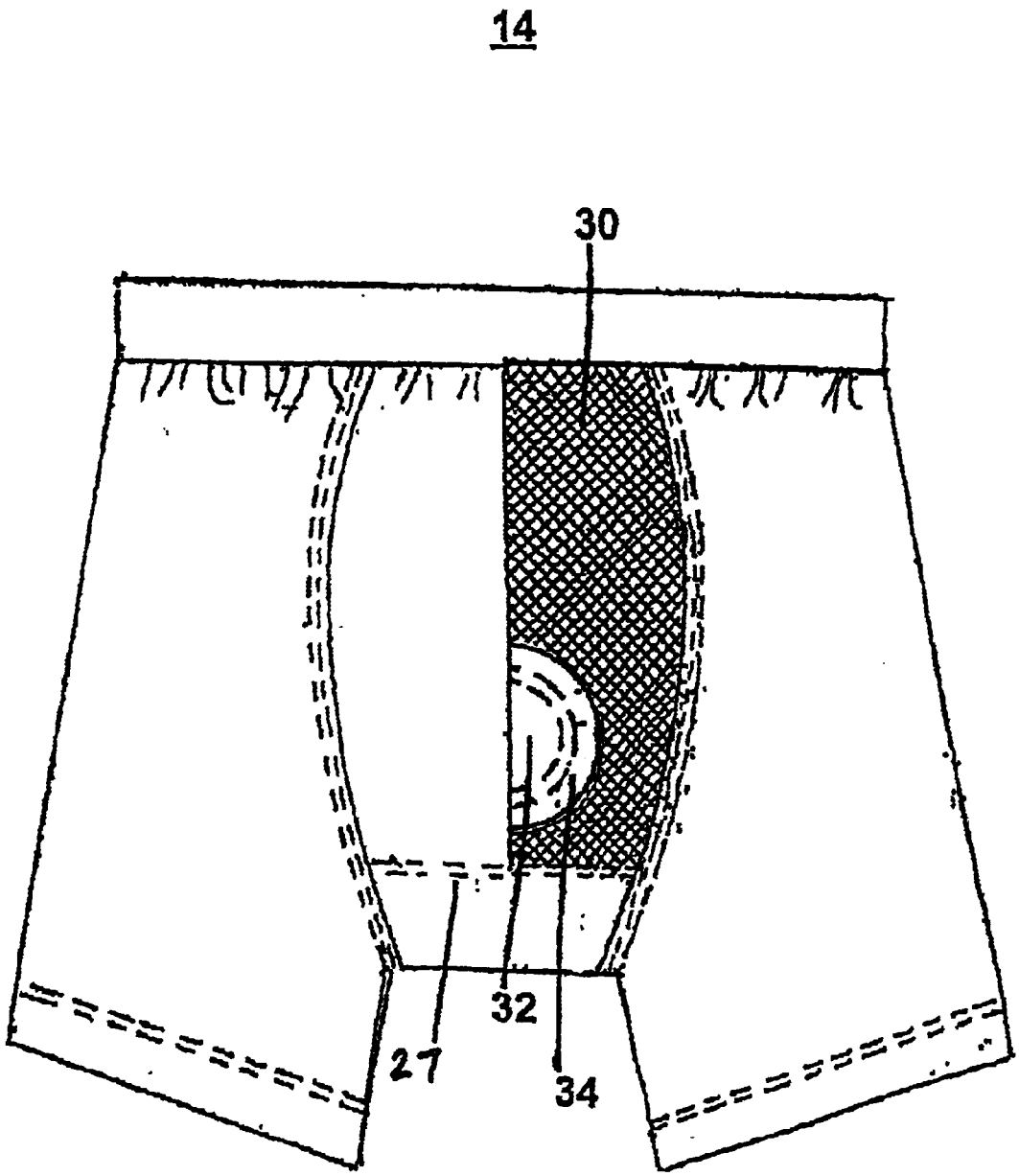
FIG. 6 shows the front panel in accordance with another aspect of the invention that is partially cut off to show a second gusset.
Figure 7:
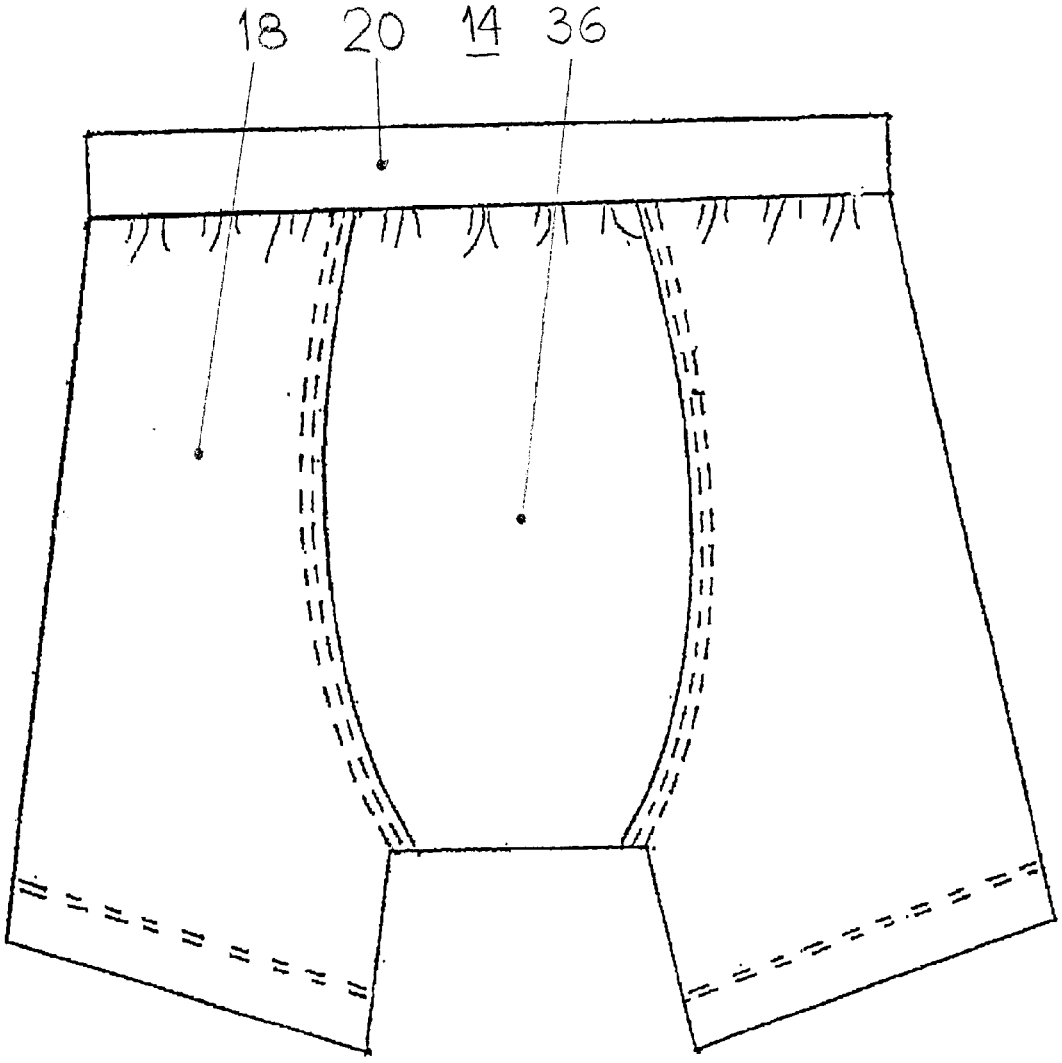
FIG. 7 shows a back panel in accordance with another aspect of the invention.
Figure 8:
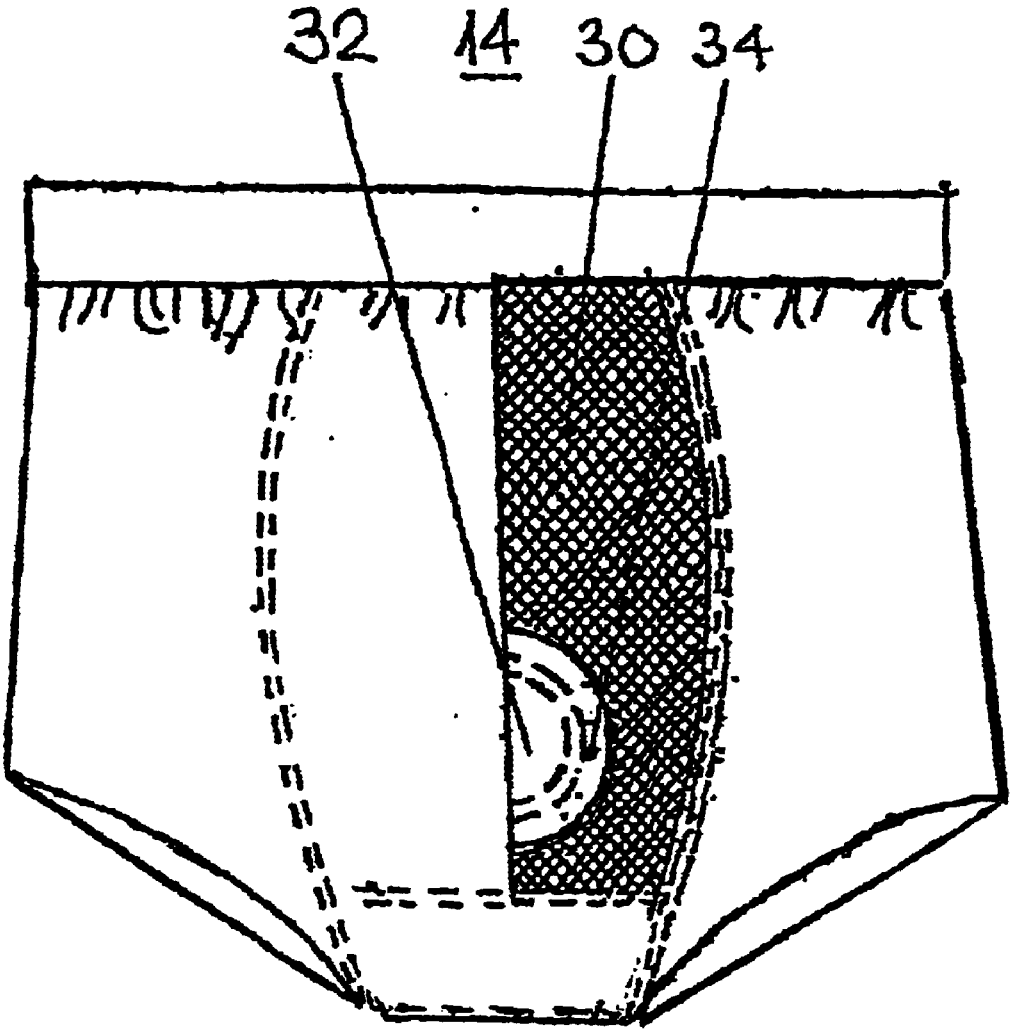
FIG. 8 illustrates men's briefs in accordance with the invention where the front panel is partially cut off to show an additional panel.
Figure 9:
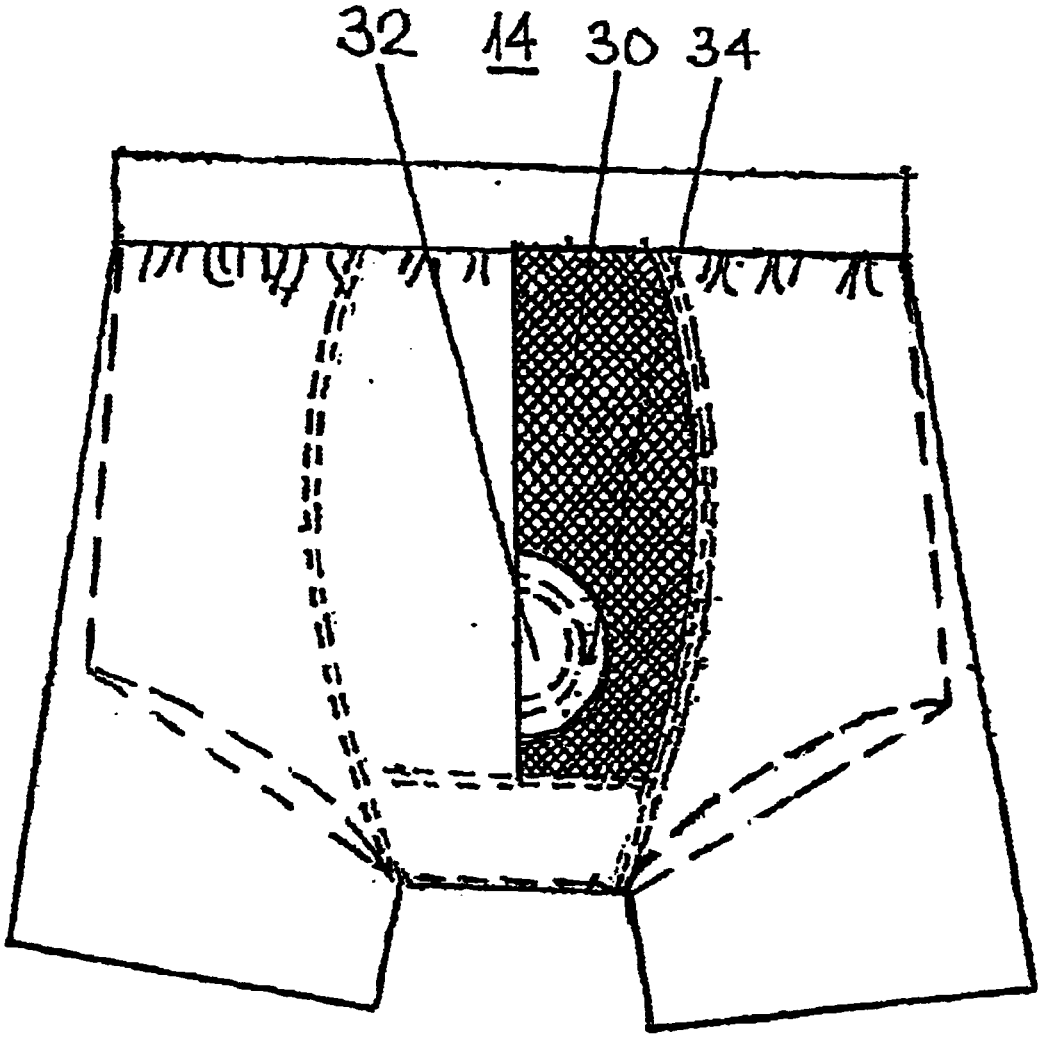
FIG. 9 shows the briefs of FIG. 8 with a short-legged outside portion.
Figure 10:
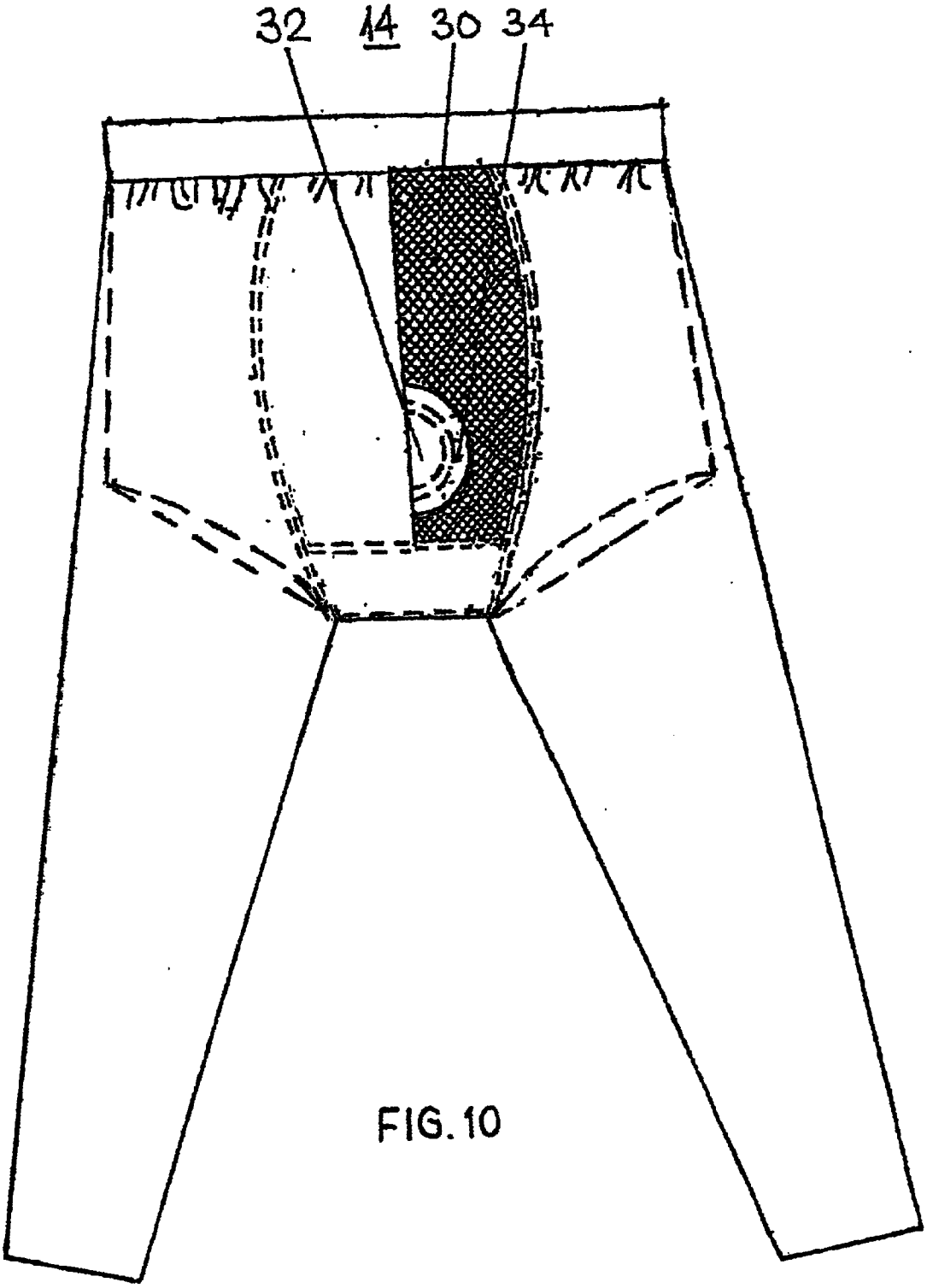
FIG. 10 depicts the briefs of FIG. 8 with a long-legged outside portion.

Referring now to FIGS. 4–6 where another embodiment of the present invention is shown with the proportions that may differ from those in a real article, briefs 14 comprise a front panel 16 and a back panel 18 connected to each other and to a waist band 20 made of a stretchable material. The front panel 16 and the back panel 18 are spaced apart from each other to define a first cavity therebetween (not shown) for accommodating the body of a user.

The front panel 16 is provided with a first gusset 22 connected to the rest of the front panel 16 by seams 24, 26. There is a fly front portion 28 made in the first gusset 22 that may have a zip closure shown by convention by a dotted line 29.

The briefs 14, according to the second embodiment of the present invention, comprise a second gusset 30, which is preferably, but not exclusively, made of a netlike material. The second gusset 30 is connected to the first gusset 22, for example by means of the side seams 24 and 26 and a bottom seam 27. The size of the second gusset 30 allows it to be spaced apart from the first gusset 22 with the formation of a second cavity therebetween (not shown).

The second gusset 30 is made with an opening 32 that provides a communication between the cavities and allows user's genitalia to be passed through to the second cavity, the scrotum being supported by the second cavity bottom defined by the seam 27. The opening 32 may be provided with a cuff 34 to create more comfort for the user. For better appearance, the back panel 18 may also have a gusset 36.

While several embodiments of the present invention have been disclosed hereinabove, it is to be understood that these embodiments are given by example only and not in a limiting sense. Those skilled in the art may make various modifications and additions to the preferred embodiments chosen to illustrate the invention without departing from the spirit and scope of the present contribution to the art. Accordingly, it is to be realized that the patent protection sought and to be afforded hereby shall be deemed to extend to the subject matter claimed and all equivalence thereof fairly within the scope of the invention.

What is claimed is:

1. Men's briefs comprising:

a front panel and a back panel connected to each other, the front panel and the back panel being spaced apart from each other to define a first cavity therebetween, the front panel being provided with a first gusset in a central portion thereof, and a second gusset connected to the first gusset, the second gusset being of the size to be spaced apart from the first gusset to form a second cavity therebetween to accommodate user's penis and scrotum, the second gusset being provided with an opening to allow communication between the first and the second cavities, the opening being of the size large enough to let user's penis and scrotum be put from the first cavity into the second cavity to thus have them isolated from the perineum, the second gusset being connected to the first gusset by at least two side seams and a bottom seam, the second cavity being of the size to allow the scrotum to be supported by a bottom of the second cavity.

2. The men's briefs according to claim 1, further comprising a cuff around the opening.

3. The men's briefs according to claim 1, wherein the first gusset is provided with a fly front portion.

4. The men's briefs according to claim 3, wherein the fly front portion is provided with a zip closure.

5. Men's briefs comprising:

a front panel and a back panel connected to each other, the front panel and the back panel being spaced apart from each other to define a first cavity therebetween, and an additional panel connected to the front panel, the additional panel being of the size to be spaced apart from the front panel to form a second cavity therebetween to accommodate user's penis and scrotum, the additional panel being provided with an opening to allow communication between the first and the second cavities, the opening being of the size large enough to let user's penis and scrotum be put from the first cavity into the second cavity to thus have them isolated from the perineum, the additional panel being connected to the front panel by at least two side seams and a bottom seam, the second cavity being of the size to allow the scrotum to be supported by a bottom of the second cavity.

6. The men's briefs according to claim 5, further comprising an outside portion connected to the front panel and to the back panel.

7. The men's briefs according to claim 6, wherein the outside portion includes a short-legged clothing.

8. The men's briefs according to claim 6, wherein the outside portion includes a long-legged clothing.

* * * * *